US011452315B2

(12) United States Patent
Anderson

(10) Patent No.: US 11,452,315 B2
(45) Date of Patent: Sep. 27, 2022

(54) FOOT POSITIONING DEVICE

(71) Applicant: Sarah A. Anderson, East Greenbush, NY (US)

(72) Inventor: Sarah A. Anderson, East Greenbush, NY (US)

(73) Assignee: Celer Ergonomics, LLC, East Greenbush, NY (US)

( * ) Notice: Subject to any disclaimer, the term of this patent is extended or adjusted under 35 U.S.C. 154(b) by 8 days.

(21) Appl. No.: 16/926,043

(22) Filed: Jul. 10, 2020

(65) Prior Publication Data

US 2020/0337384 A1 Oct. 29, 2020

Related U.S. Application Data

(63) Continuation of application No. 15/213,949, filed on Jul. 19, 2016, now Pat. No. 10,888,128.

(60) Provisional application No. 62/198,660, filed on Jul. 29, 2015.

(51) Int. Cl.
*A41B 11/02* (2006.01)

(52) U.S. Cl.
CPC ..... *A41B 11/02* (2013.01)

(58) Field of Classification Search
CPC . A41F 9/00; A41F 9/002; A41F 9/025; A41B 11/02
See application file for complete search history.

(56) References Cited

U.S. PATENT DOCUMENTS 459,616 A * 9/1891 Rohonczy ..... A61F 5/0111 602/27
1,462,534 A * 7/1923 Condylis ..... A61F 13/066 602/66
2,353,567 A * 7/1944 Key ..... A41F 9/02 2/311
2,671,217 A * 3/1954 Studler ..... A41C 3/00 450/86
3,383,708 A * 5/1968 Pappas ..... A61F 13/066 2/22
3,555,569 A * 1/1971 Jones ..... A41F 9/002 2/221
3,769,722 A 11/1973 Rhee
4,085,746 A * 4/1978 Castiglia ..... A61F 13/066 602/65
4,334,528 A 6/1982 Gauvry
4,461,288 A 7/1984 Curtis
4,649,939 A * 3/1987 Curtis ..... A43B 7/1495 602/27
5,050,620 A 9/1991 Cooper
5,086,758 A * 2/1992 Schiek, Sr. ..... A61F 5/028 128/876

(Continued)

OTHER PUBLICATIONS

Bellchamber, et al., "Contributions of proximal and distal moments to axial tibial rotation during walking and running," Journal of Biomechanics, 2000, 7 pages.

(Continued)

*Primary Examiner* — Tajash D Patel
(74) *Attorney, Agent, or Firm* — LaBatt, LLC

(57) ABSTRACT

A foot positioning device is described. The device includes a strap, which can be utilized to place the foot in a desired position. The device can further include an article of footwear, such as a sock, which can assist with placement of the strap.

20 Claims, 9 Drawing Sheets

(56) References Cited

U.S. PATENT DOCUMENTS

| | | | | |
|---|---|---|---|---|
| 5,323,549 | A * | 6/1994 | Segel | A43B 7/1495 36/140 |
| 5,896,859 | A * | 4/1999 | Carroll | A61G 7/1023 128/845 |
| 6,058,504 | A * | 5/2000 | Tollini | A63B 71/1225 2/311 |
| 6,196,986 | B1 | 3/2001 | Gardiner | |
| 6,364,614 | B1 | 4/2002 | Winatsakanian | |
| 6,398,749 | B1 | 6/2002 | Slautterback | |
| 6,454,733 | B1 | 9/2002 | Krusenklaus | |
| 6,545,193 | B1 | 4/2003 | Morgenstern | |
| 7,166,760 | B1 * | 1/2007 | Talbot | A61F 5/0111 602/5 |
| D600,438 | S | 9/2009 | Edy et al. | |
| D612,061 | S | 3/2010 | Alvarez | |
| D633,657 | S | 3/2011 | Oban | |
| 8,679,045 | B2 | 3/2014 | Dao | |
| D703,336 | S | 4/2014 | Eldridge | |
| D705,523 | S * | 5/2014 | Henry | D2/853 |
| D739,647 | S | 9/2015 | House | |
| D774,654 | S | 12/2016 | Anderson | |
| 9,561,397 | B2 | 2/2017 | Zaki | |
| 9,615,954 | B2 | 4/2017 | Blue | |
| 9,913,505 | B1 * | 3/2018 | Wilson | A41F 17/00 |
| 10,888,128 | B1 * | 1/2021 | Anderson | A41B 11/02 |
| 2002/0088144 | A1 | 7/2002 | Katz et al. | |
| 2008/0243173 | A1 | 10/2008 | Thorpe | |
| 2011/0191942 | A1 | 8/2011 | Villalobos | |
| 2013/0310723 | A1 | 11/2013 | Chiang | |
| 2014/0041099 | A1 | 2/2014 | Boyd et al. | |
| 2015/0096107 | A1 | 4/2015 | Krumel | |
| 2018/0014591 | A1 * | 1/2018 | Groff | A41F 9/002 |

OTHER PUBLICATIONS

Braceability, "BraceAbility Slip-on Elastic Foot Wrap & Ankle Support Sleeve," https://web.archive.org/web/20140728010207/http://www.braceability.c . . . , Accessed on Sep. 4, 2015, 3 pages.
Fredericson, et al., "Epidemiology and Aetiology of Marathon Running Injuries," Sports Medicine, 2007, 4 pages.
Goss, et al., "Lower Extremity Biomechanics and Self-Reported Foot-Strike Patterns Among Runners in Traditional and Minimalist Shoes," Journal of Athletic Training,2015, 9 pages.
Goss, et al., "Relationships Among Self-reported Shoe Type, Footstrike Pattern, and Injury Incidence," The United States Army Medical Department Journal, 2012, pp. 25-30.
Hageman, "Medial longitudinal arch mechanics before and after a prolonged run," Iowa State University, Graduate Theses and Dissertations, 2010, 93 pages.
Hasegawa, et al. "Foot strike patterns of runners at the 15-km point during an elite-level half marathon," J Strength Cond Res, 2007, Abstract, 2 pages.
Hashish, et al., "Ground Reaction Forces in Barefoot Running Before and After Exertion," 2011, 2 pages.
Hashish, et al., "Mechanical Demand Distribution During Shod and Novice Barefoot Running," 2012, 2 pages.
Judah, "The glory trail," Edited extract from "Bikila: Ethiopia's Barefoot Olympian," 2008, http://www.theguardian.com/books/2008/jul/26/books.sport.
Kaplan, "Barefoot Versus Shoe Running: From the Past to the Present." Phys Sportsmed, 2014, 7 pages.
Ker, et al., "The spring of the arch of the human foot," Nature, Jan. 1987, 4 pages, vol. 325.
Kulmala, et al., "Forefoot Strikers Exhibit Lower Running-Induced Knee Loading than Rearfoot Strikers," Medicine and Science in Sports and Exercise, 2013, 8 pages.
Lieberman, et al., "Foot strike patterns and collision forces in habitually barefoot versus shod runners," Nature, 2010, 6 pages.
Lorenz, et al., "Is There Evidence to Support a Forefoot Strike Pattern in Barefoot Runners? A Review," Athletic Training, 2012, 5 pages.
Loudon, et al., "Lower extremity kinematics in running athletes with and without a history of medial shin pain," International Journal of Sports Physical Therapy, Aug. 2012, 9 pages.
Lutter, "Foot-related knee problems in the long distance runne". Foot and Ankle International, 1980, Abstract, 1 page.
Medco, "Elastic Ankle Wrap," http://web.archive.org/web/20150528163223/https://www.medco-athletic, Accessed on Sep. 4, 2015, 1 page.
Mccallion, et al., "Acute Differences in Foot Strike and Spatiotemporal Variables for Shod, Barefoot or Minimalist Male Runners," Journal of Sports Science Medicine, May 2014, 11 page.
Miller, et al., "The effect of minimal shoes on arch structure and intrinsic foot muscle strength," Journal of Sport and Health Science, Jun. 2014, pp. 74-85, vol. 3, Issue 2.
"Muscles of the Ankle and Foot," Date Unavailable, 85 pages, http://www.ux1.eiu.edu/~cfje/2440/ankle-muscles.pdf.
Novacheck, "Review Paper: The biomechanics of running," Gait Posture, 1998, 19 pages.
"Orthotics vs Spring Down Image," http://teamdoctorsblog.com/wp-content/uploads/2012/12/Orthoticsvsspr . . . , 2012, 1 page.
Perl, et al., "Effects of Footwear and Strike Type on Running Economy," Official Journal of the American College of Sports Medicine, 2016, 10 pages.
Pomeroy, R., "What is the Best Way to Run?" Real Clear Science, 2015, 3 pages.
Sinclair, J., "Barefoot and shod running: their effects on foot musclekinetics," The Foot and Ankle Online Journal, 2015, 5 pages.
Sobhani, et al., "Rocker shoe, minimalist shoe, and standard running shoe: a comparison of running economy," Journal of Science and Medicine in Sport, 2014, Abstract, 2 pages, vol. 17, Issue 3.
Stoxen, "Morton's Neuroma—Self Help Tips, Treatment and Prevention From the Barefoot Running Doctor at Team Doctors," 2012, 25 pages, http://teamdoctorsblog.com/2012/12/24/mortons-neuroma-self-help-tips-treatment-and-prevention-from-the-barefoot-running-doctor-at-team-doctors/.
Strassburg Sock, "The Sock: Wearing Instructions," https://web.archive.org/web/20141208175405/http://thesock.com/works . . . , Accessed on Sep. 4, 2015, 3 pages.
Taunton, et al., "A retrospective case-control analysis of 2002 running injuries," Br J Sports Med., 2002, 7 pages.
Yates, et al., "The Incidence and Risk Factors in the Development of Medial Tibial Stress Syndrome Among Naval Recruits," The American Journal Sports Medicine, 2004, 9 pages.
Sutton, A., U.S. Appl. No. 15/213,949, Notice of Allowance, dated Sep. 10, 2020, 9 pages.
Sutton, A., U.S. Appl. No. 15/213,949, Advisory Action 2b, dated Jun. 12, 2020, 4 pages.
Sutton, A., U.S. Appl. No. 15/213,949, Advisory Action 2, dated Apr. 6, 2020, 3 pages.
Sutton, A., U.S. Appl. No. 15/213,949, Final Office Action 2, dated Jan. 13, 2020, 10 pages.
Suttion, A., U.S. Appl. No. 15/213,949, Office Action 2, dated Nov. 8, 2018, 7 pages.
Sutton, A., U.S. Appl. No. 15/213,949, Final Office Action1, dated Mar. 1, 2018, 20 pages.
Sutton, A., U.S. Appl. No. 15/213,949, Office Action1, dated Sep. 8, 2017, 14 pages.

* cited by examiner

FOOT POSITIONING DEVICE

REFERENCE TO RELATED APPLICATIONS

The current application is a continuation of U.S. patent application Ser. No. 15/213,949, filed on 19 Jul. 2016, and which claims the benefit of U.S. Provisional Application No. 62/198,660, filed on 29 Jul. 2015, each of which is hereby incorporated by reference.

TECHNICAL FIELD

The disclosure relates generally to a strap to be worn on a foot, and more particularly, to a strap, which can be utilized to improve running form, as a recovery aid, and/or the like.

BACKGROUND ART

Many athletic sport shoes made for a sport that involves running have cushioned and slightly elevated heels. This shoe configuration makes it easy for the user to "heel strike," when running. This benefit is intentional, allowing the shoe's technology to do the work of running for the user. As shown in FIG. 1A, when running in this manner, the heel is the first part of the foot to strike the ground, the upper body is tall and straight, and the landing leg is straight and forward of the torso as the foot touches down. However, the body has evolved and developed its own internal shock absorbing system. The perceived feeling of comfort and cushion provided by athletic sport shoes is not related to how well the body absorbs impact shock. Furthermore, running in a manner shown in FIG. 1A is not efficient.

When running without shoes, as shown in FIG. 1B, a runner naturally adopts a "midfoot strike," which provides a low-impact, highly efficient form of running. In this running style, the mid-forefoot is the first to impact the ground at ground impact, and lightly at that. The landing leg is beneath the torso and slightly bent, putting the body in a more advantageous position to absorb the impact. Additionally, the upper body is short and sleek. A midfoot strike ensures that the foot is centered closer to the body's center of mass, thus allowing the force felt on impact (e.g., approximately 2.5 times the body weight) to be safely absorbed and propagated throughout the body more efficiently and effectively than with an extended heel strike.

FIG. 1C illustrates the different positions of the foot when using the different running styles. In particular, when using a "heel strike" running style, the ankle is slightly dorsiflexed at ground contact. In contrast, when using a "midfoot strike" running style, the ankle is slightly plantarflexed at ground contact.

FIGS. 2A and 2B show force diagrams for heel strike and midfoot strike running styles, respectively. As illustrated, the midfoot strike running style provides a much more uniform force variation than does the heel strike running style.

SUMMARY OF THE INVENTION

Aspects of the invention provide a foot positioning device, which includes a strap, with or without an article of footwear (e.g., a sock), which can be utilized to place the foot in a desired position. For example, the strap can be configured to place the foot in a position that facilitates running with a midfoot strike. The strap also can be placed on the foot in a position to aid a user with an injury to the foot.

A first aspect of the invention provides a strap comprising: a first portion configured for placement along a forward portion of a foot; and second and third portions adjacent to opposing sides of the first portion and laterally offset from the first portion.

A second aspect of the invention provides a foot positioning device, the device comprising: a strap including: a first portion; and second and third portions adjacent to opposing sides of the first portion and laterally offset from the first portion, wherein at least the second and third portions of the strap are formed of a rubber latex material.

A third aspect of the invention provides a foot positioning device comprising: a sock; and a strap attached to the sock, the strap including: a first portion; second and third portions adjacent to opposing sides of the first portion and laterally offset from the first portion by an offset distance; and means for temporarily securing a first end of the strap to a second end of the strap.

The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

FIGS. 1A and 1B show heel strike and midfoot strike running styles, respectively, while

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a foot positioning device, which includes a strap, with or without an article of footwear (e.g., a sock), which can be utilized to place the foot in a desired position. For example, the strap can be configured to place the foot in a position that facilitates running with a midfoot strike. The strap also can be placed on the foot in a position to aid a user with an injury to the foot.

As used herein, unless otherwise noted, the term "set" means one or more (i.e., at least one) and the phrase "any solution" means any now known or later developed solution. As also used herein, the term "approximately" means within +/− twenty percent.

Figure 1A:
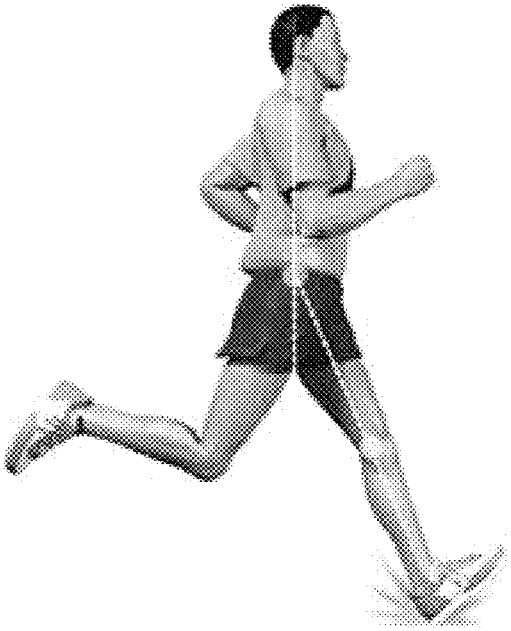
Figure 1B:
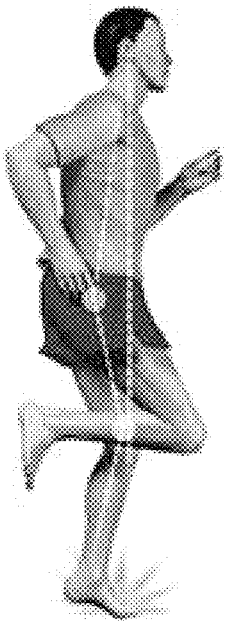
Figure 1C:
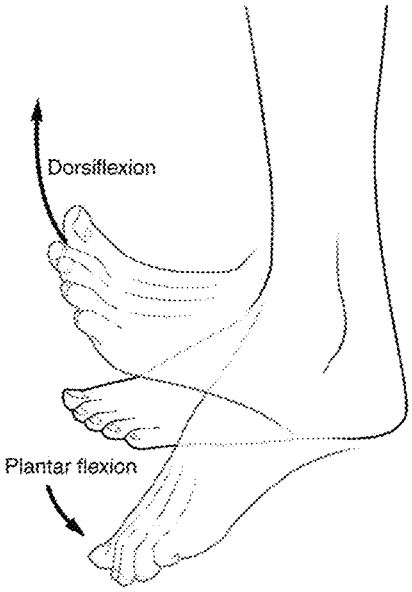
FIG. 1C illustrates plantar flexion and dorsiflexion of the ankle.
Figure 2A:
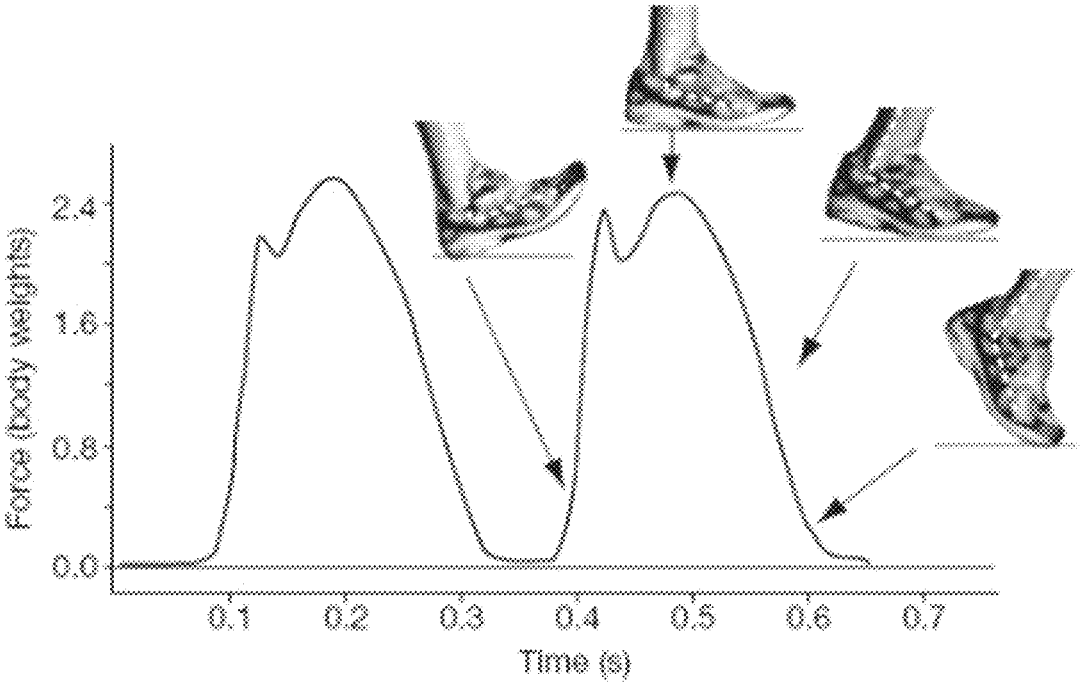
FIGS. 2A and 2B show force diagrams for heel strike and midfoot strike running styles, respectively.
Figure 2B:
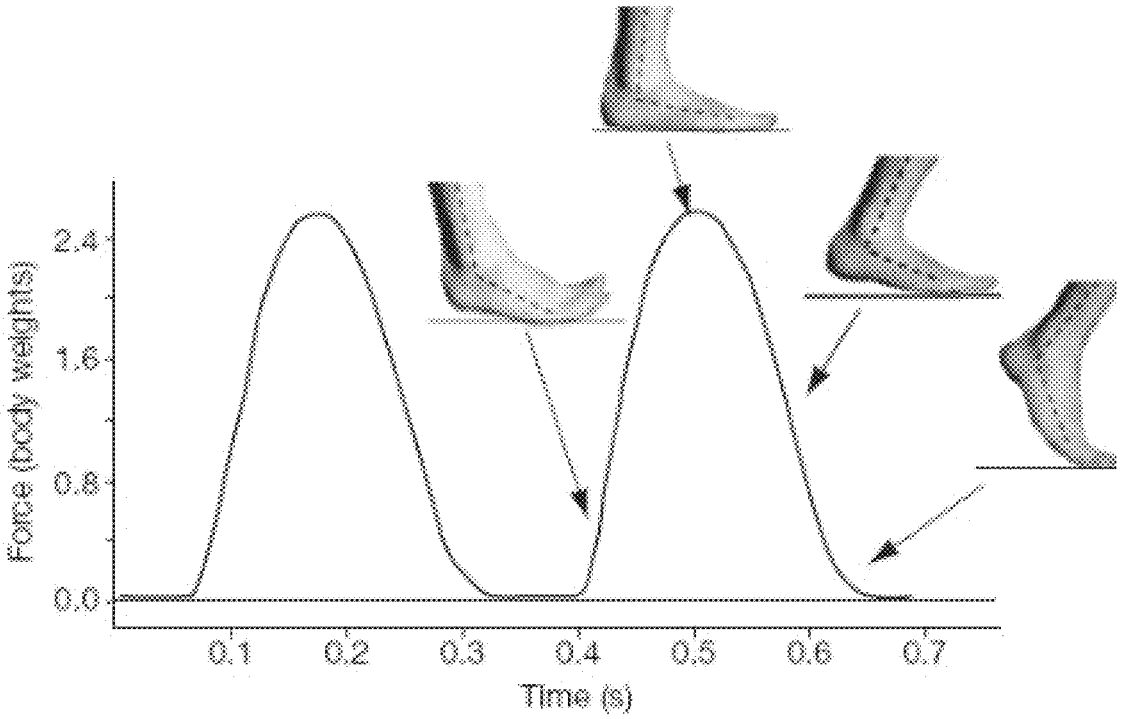
Figure 3A:
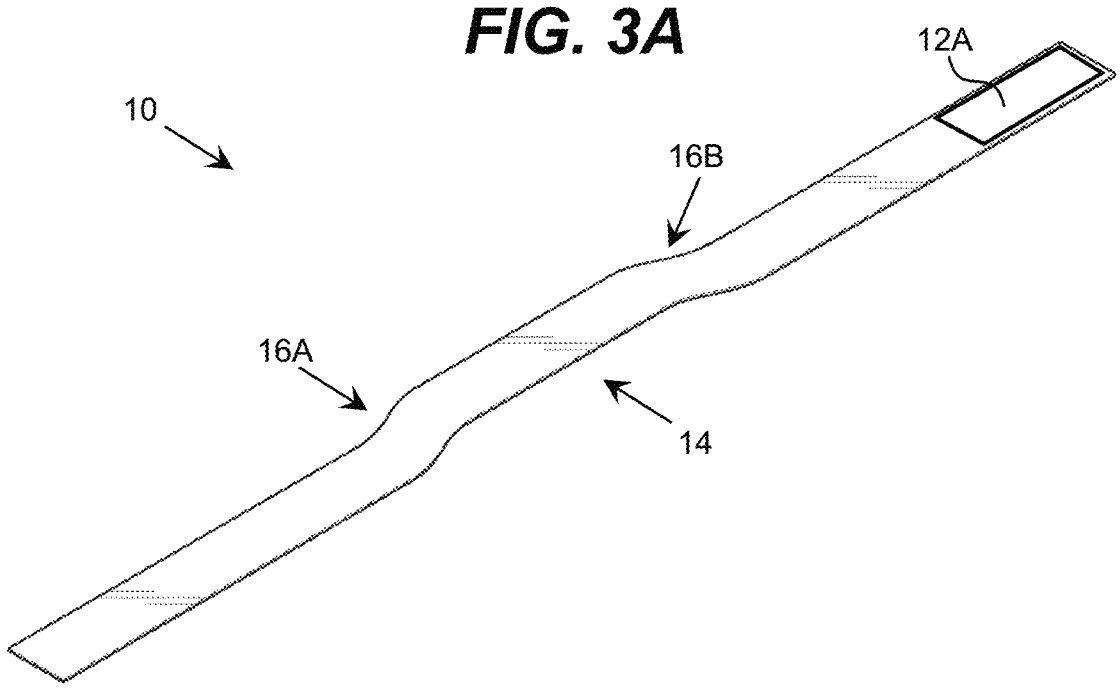
FIGS. 3A-3C show perspective, front, and back views, respectively, of an illustrative strap according to an embodiment.
Figure 3B:
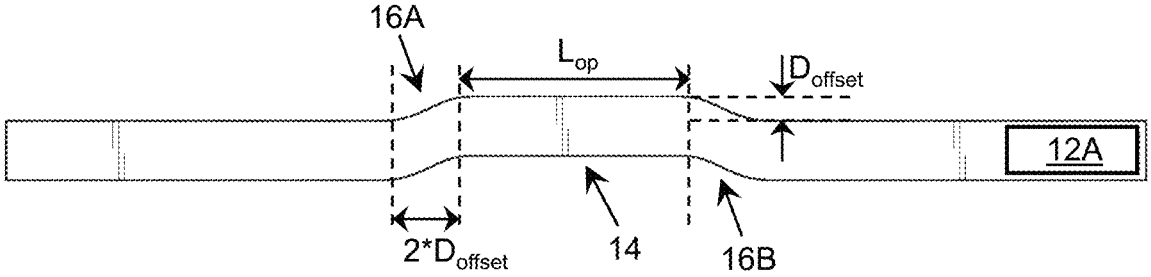
Figure 3C:
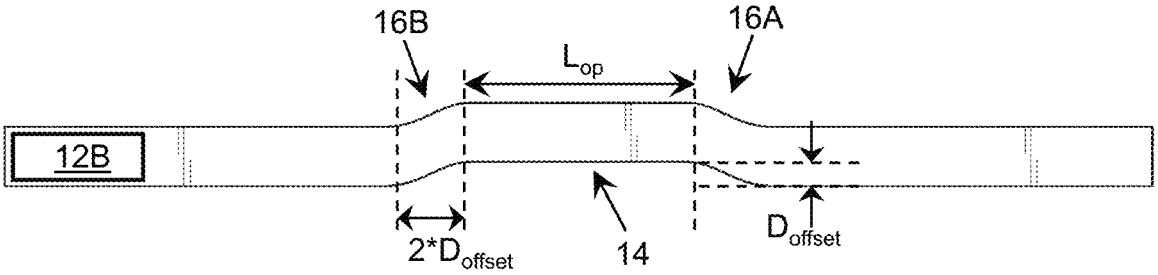
Figure 4A:
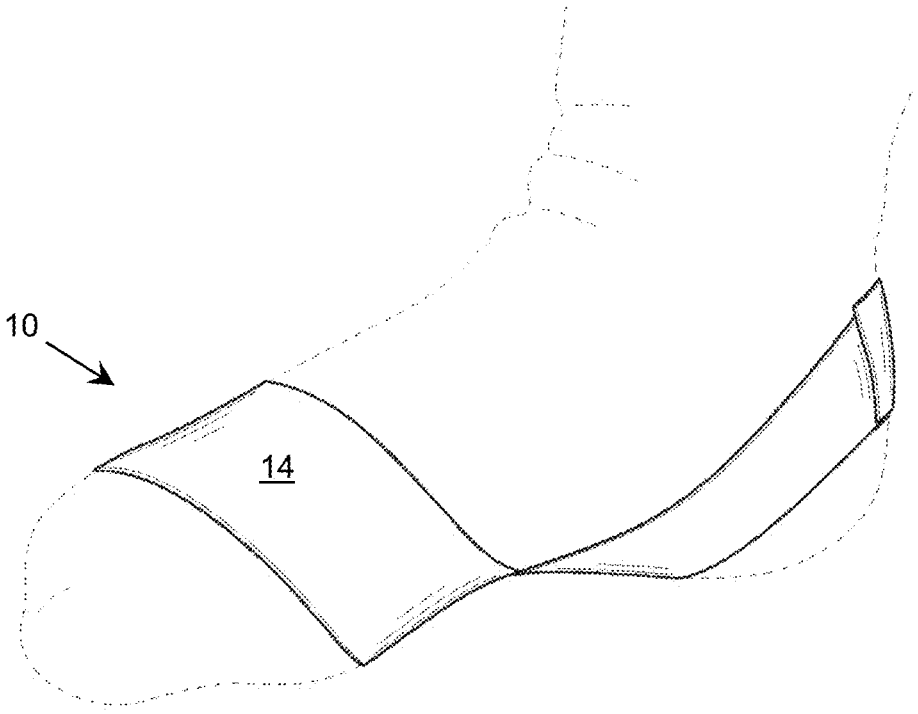
FIGS. 4A-4D show various views of a strap placed over a sock on a foot according to an embodiment.
Figure 4B:
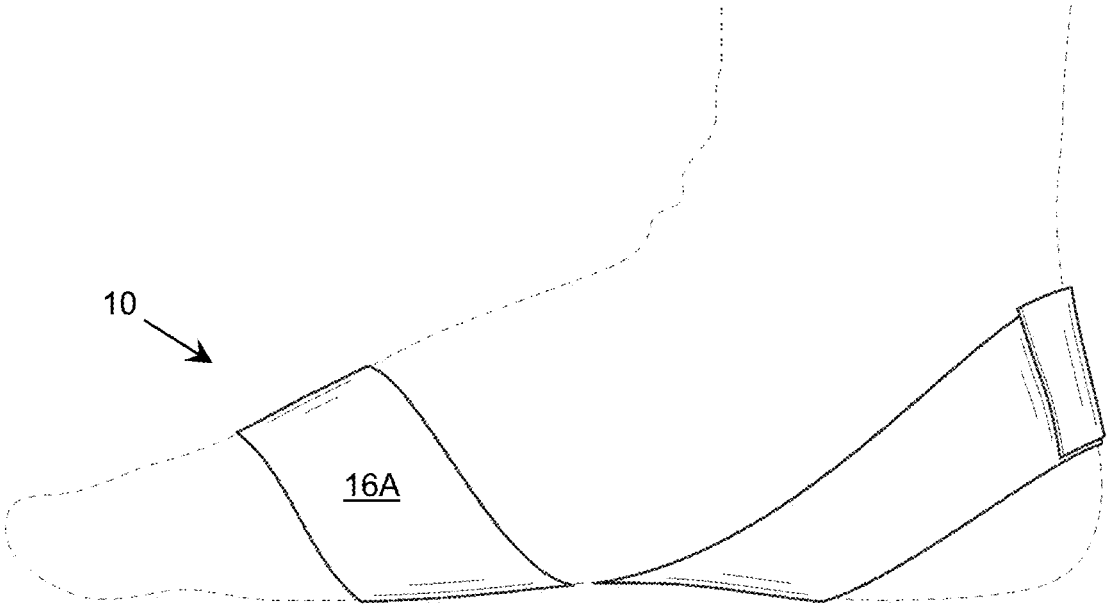
Figure 4C:
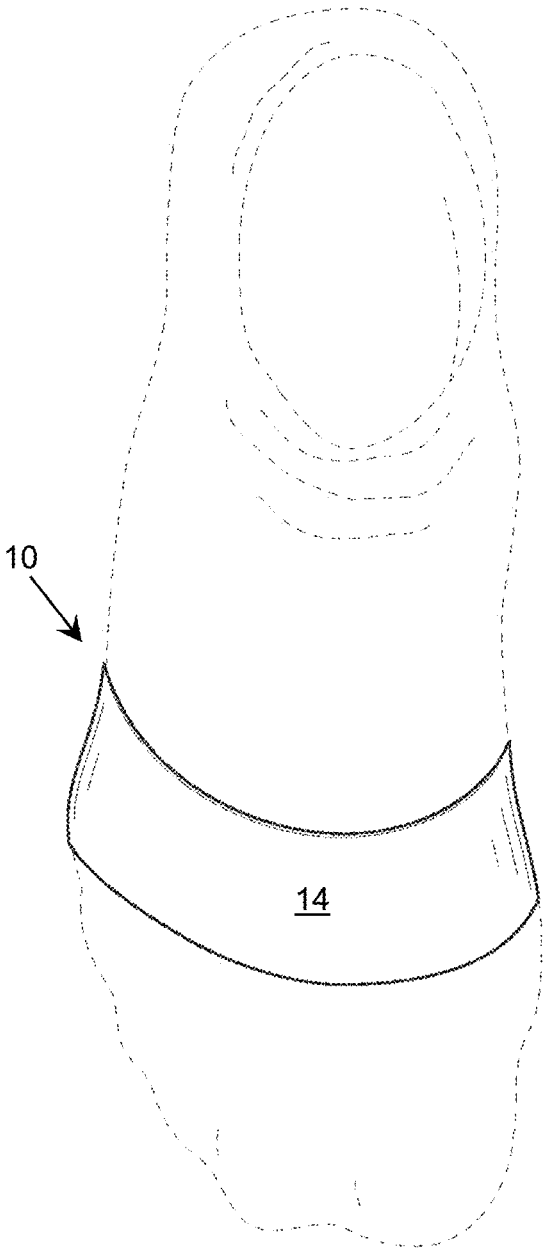
Figure 4D:
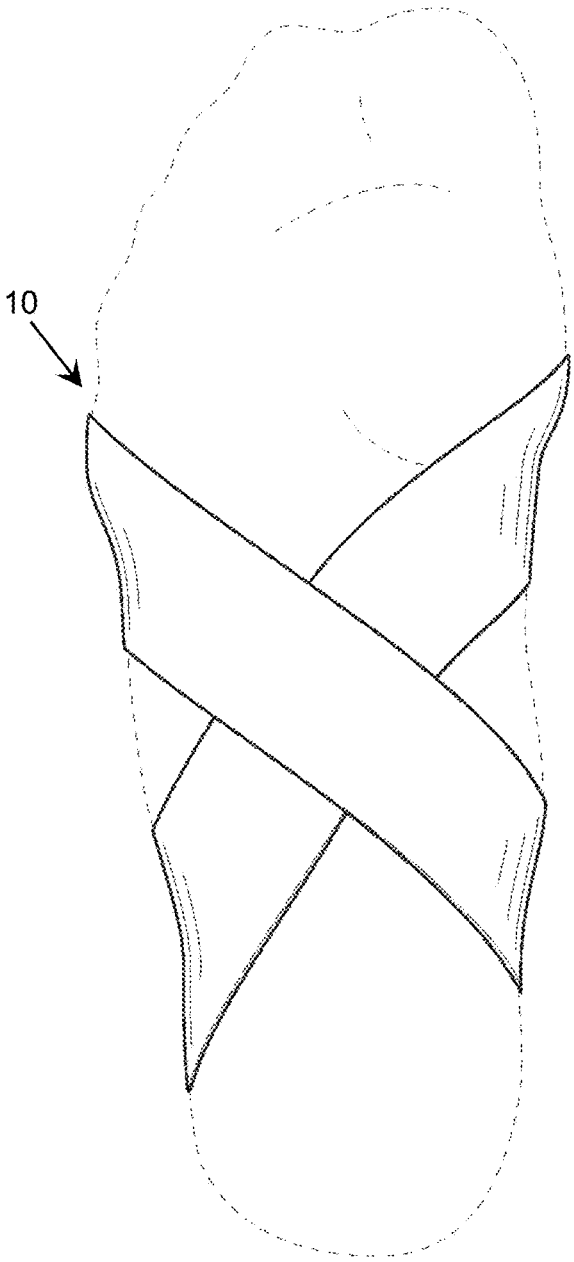
Figure 5A:
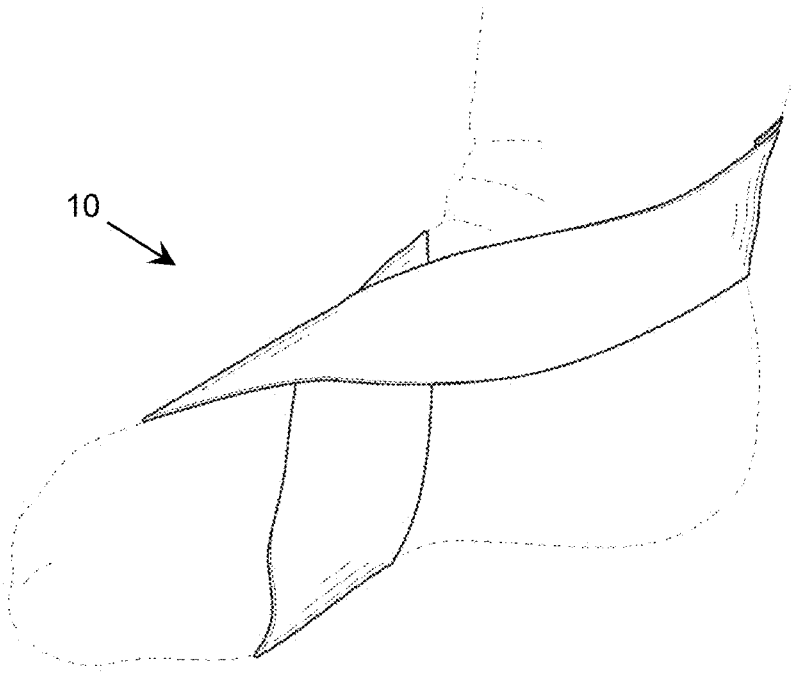
FIGS. 5A-5D show various views of a strap placed over a sock on a foot according to another embodiment.
Figure 5B:
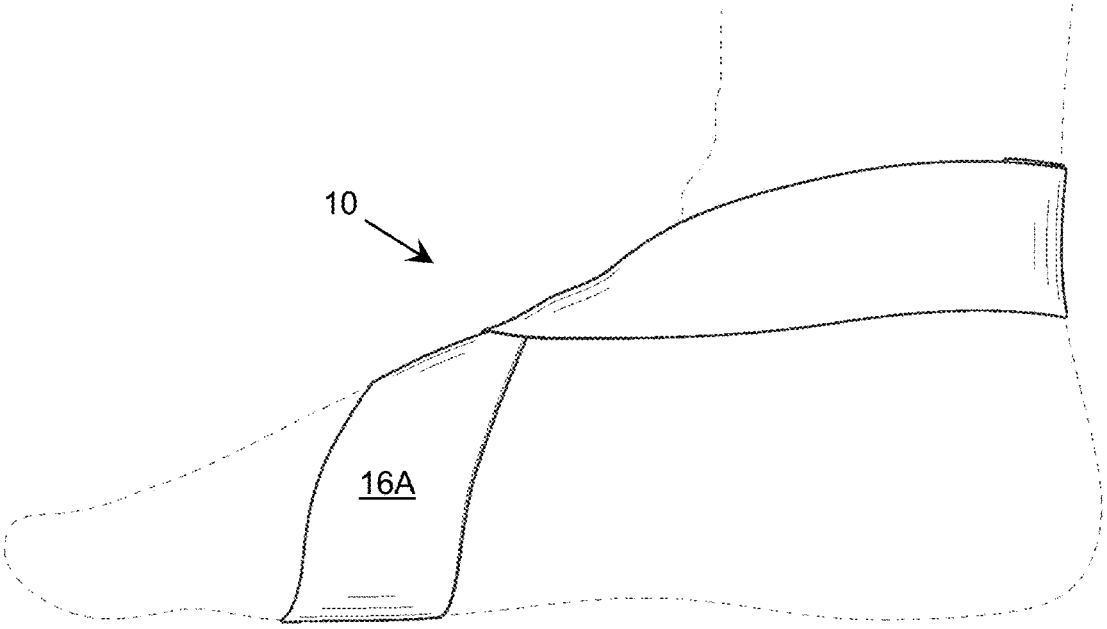
Figure 5C:
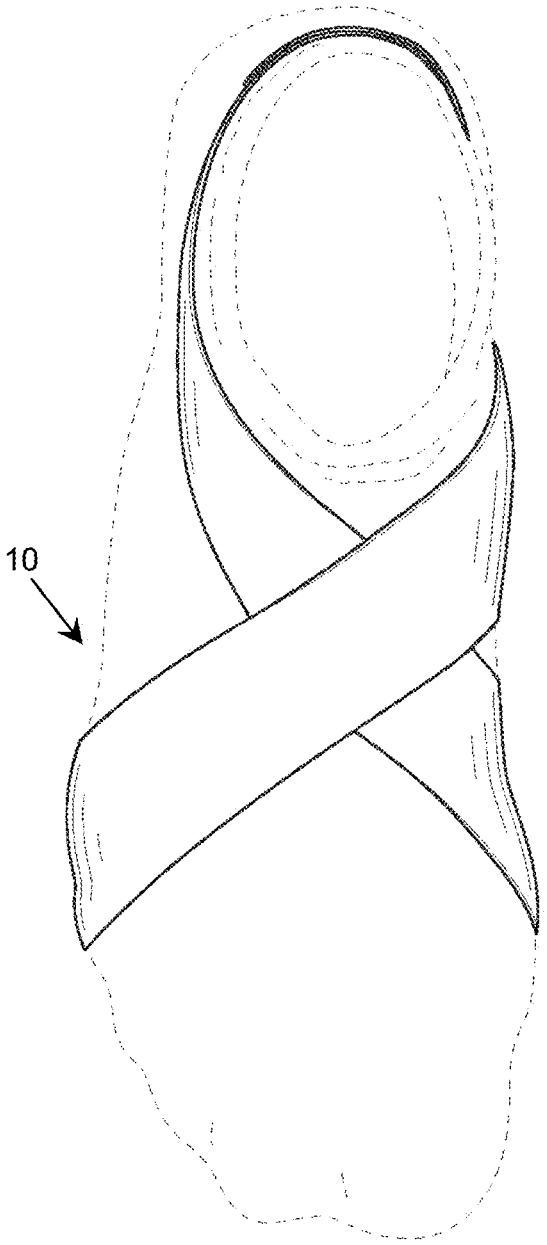
Figure 5D:
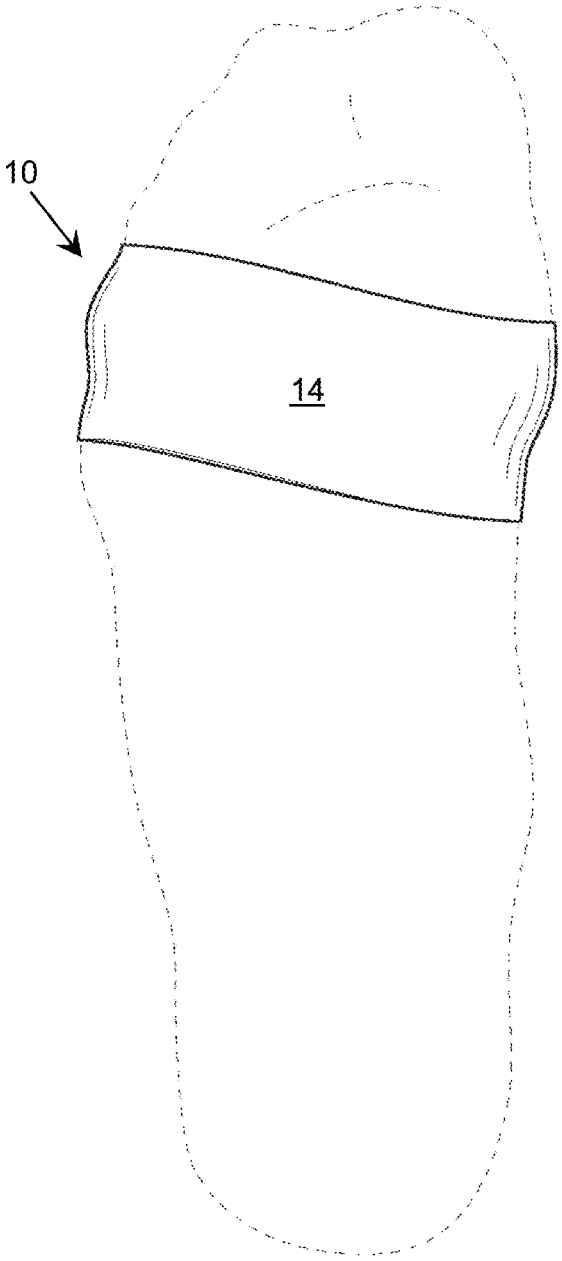
Figure 6A:
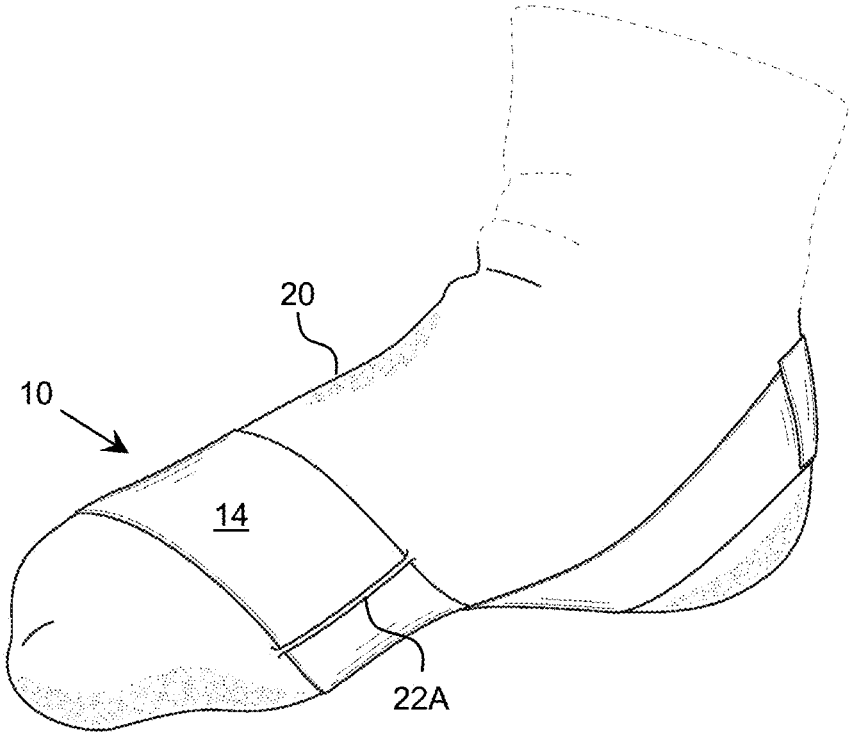
FIGS. 6A-6D show various views of a sock and integrated strap placed on a foot according to an embodiment.
Figure 6B:
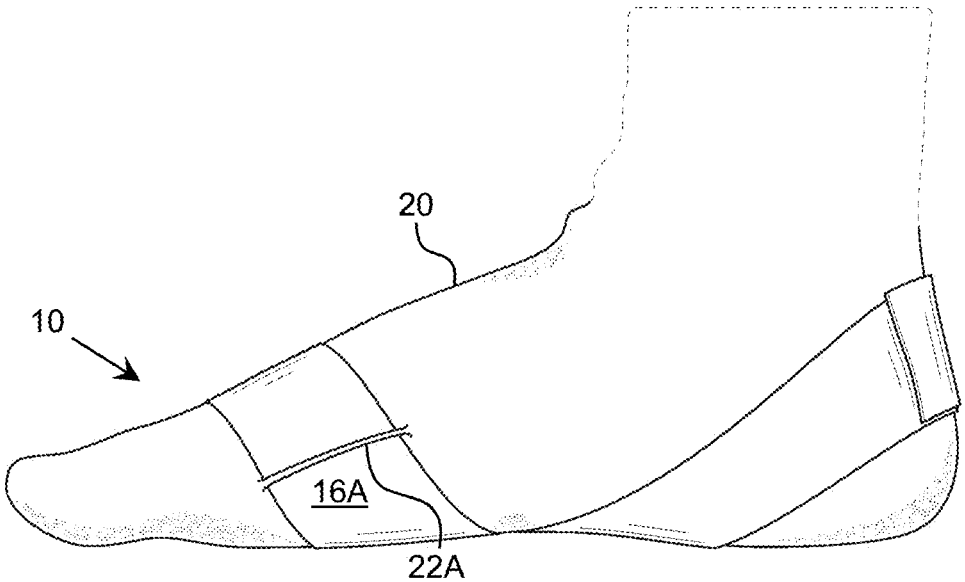
Figure 6C:
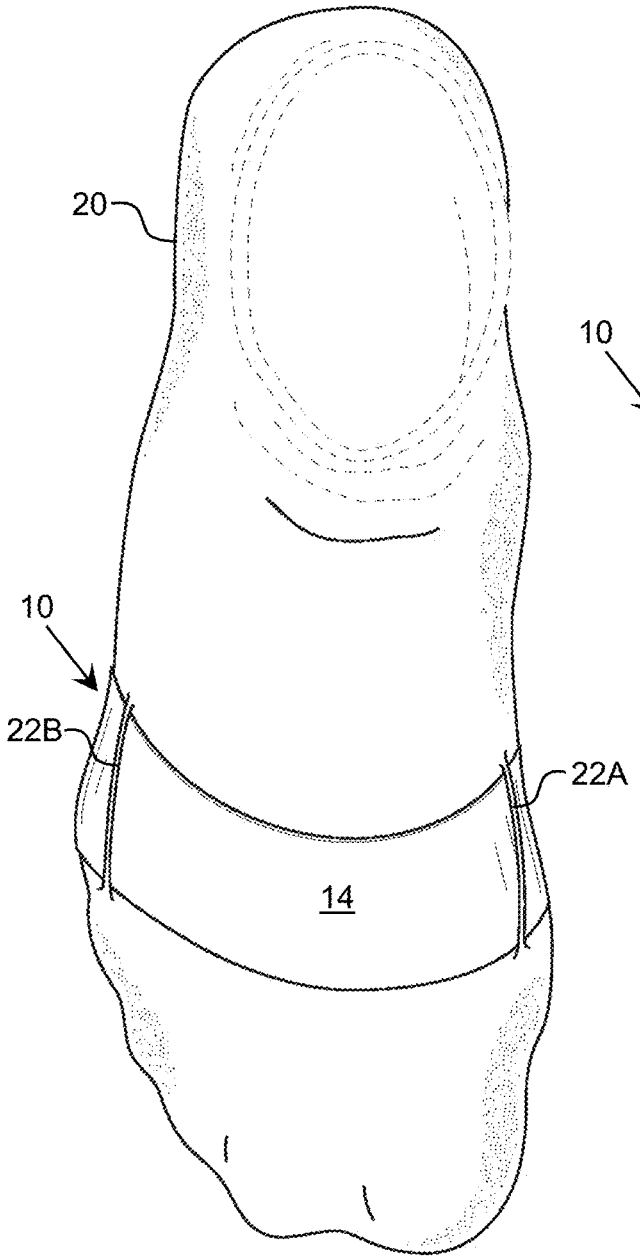
Figure 6D:
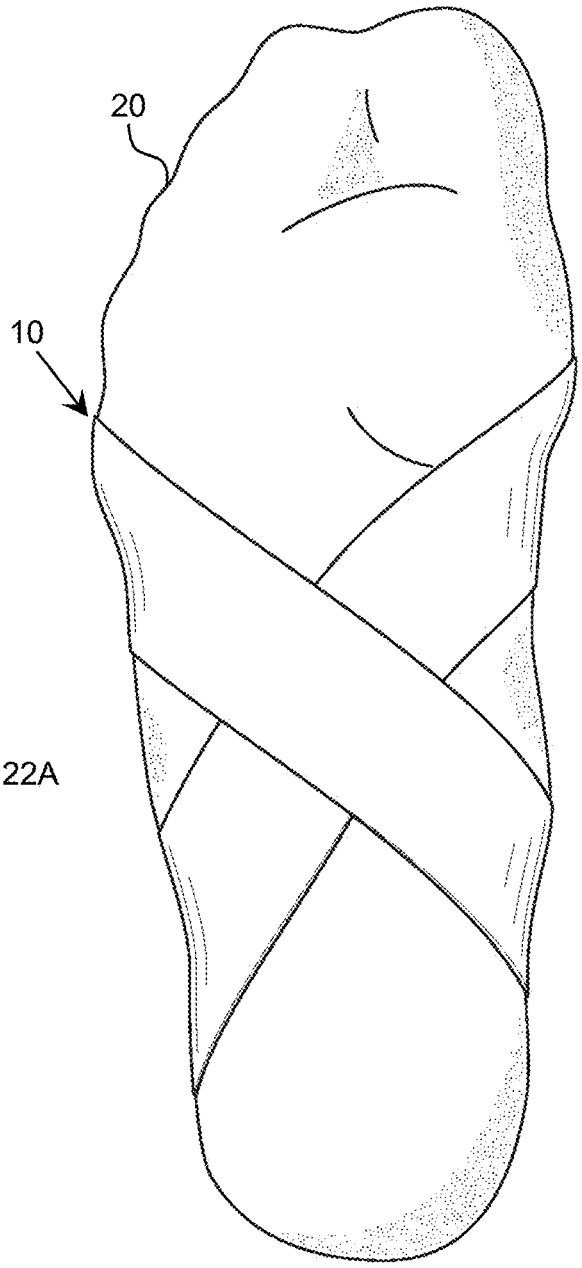

Turning to the drawings, FIGS. 3A-3C show perspective, front, and back views, respectively, of an illustrative strap 10 according to an embodiment. As illustrated, the strap 10 includes connecting mechanisms 12A, 12B located on opposing ends of the strap 10. The connecting mechanisms 12A, 12B are configured to enable the opposing ends of the strap 10 to be removably secured to one another. The connecting mechanisms 12A, 12B can utilize any solution for temporarily securing the opposing ends of the strap 10 to one another. For example, in an embodiment, the connecting mechanisms 12A, 12B comprise hook and loop fastener mechanisms, each of which can be attached to an opposing end of the strap 10 using any solution (e.g., glue, sewn, and/or the like).

However, it is understood that use of hook and loop fasteners is only illustrative, and the mechanisms 12A, 12B can implement any solution for temporarily securing the opposing ends of the strap 10. Furthermore, it is understood that while mechanisms 12A, 12B are shown located on opposing sides of both ends of the strap 10, it is understood that, depending on the securing solution utilized, the strap 10 can include mechanisms 12A, 12B located on the same side of the opposing ends, or only a mechanism located on only one end of the strap 10. To this extent, in other embodiments, the opposing ends of the strap 10 can be secured through one or more of: clips, reusable adhesive, a self-adhering property of material(s) located on the opposing ends of the strap 10, and/or the like. In still another embodiment, an embodiment of the strap 10 can comprise a loop, with no opposing ends. In this case, the strap 10 can include a mechanism for temporarily adjusting a size of the loop to accommodate feet of varying sizes.

As discussed herein, the strap 10 can be sized and configured to be wrapped around a foot of a user. To this extent, the strap 10 is shown including an offset portion 14, which is defined by a pair of transition regions 16A, 16B. As illustrated, the offset portion 14 is not aligned with the remainder of the strap 10. In an embodiment, the offset portion 14 is centrally located on the strap 10. However, it is understood that the offset portion 14 can be located anywhere along a length of the strap 10. In an embodiment, a length, $L_{op}$, of the offset portion 14 (e.g., as defined by the distance between the transition regions 16A, 16B) is selected to be approximately the same as a widest part of a foot of a target user (e.g., the forward portion of the foot, just below the metatarsals). In an embodiment, the offset portion 14 is offset from the remainder of the length of the strap 10 by an amount, $D_{offset}$, that is approximately the same as a height of the foot of the target user at the widest part of the foot. Each transition region 16A, 16B can have a length approximately twice that of the distance that the offset portion 14 is offset from the remainder of the strap 10. In a more particular embodiment, the strap 10 has a total length of approximately twenty inches (51 centimeters); the offset portion 14 of the strap 10 has a length of approximately four inches (10 centimeters) and is vertically offset from the remainder of the strap 10 by approximately 0.75 inches (2 centimeters); and each of the transition regions 16A, 16B has a length of approximately 1.5 inches (4 centimeters).

The strap 10 can be formed of any material having a sufficient strength and durability to hold the foot in a desired position during use of the strap 10. In an embodiment, the strap 10 is formed of a single, continuous strip of a rubber latex material, which has a thickness of approximately 0.04 inches (0.1 centimeters) and a width of approximately 1.5 inches (4 centimeters). However, it is understood that this is only illustrative and any comparable materials and configurations providing approximately the same strength or greater can be utilized. For example, in another embodiment, the strap 10 can be fabricated of a thin neoprene backed with polyester on one side and unbroken loop fabric on the other side or another type of synthetic rubber, having similar dimensions as described herein. Regardless, it is understood that any material having properties (e.g., strength, flexibility) similar to the materials described herein can be utilized. Furthermore, it is understood that the offset portion 14 can have a width that differs from the width of the remainder of the strap 10. Additionally, the offset portion 14 and/or the transition regions 16A, 16B can be formed of a distinct material from the end portions of the strap 10. For example, the offset portion 14 can be formed of a material having less elasticity than the end portions of the strap 10. In an embodiment, the material(s) and/or dimensions of the strap 10 are selected to allow the user to comfortably wear one or more articles of footwear, such as shoes and/or socks, over the strap 10 when it is placed on the foot while providing sufficient strength and elasticity for the desired application.

In an embodiment, the strap 10 can be placed on a foot to hold the foot in an optimal position for a midfoot/forefoot strike during running/sprinting. To this extent, FIGS. 4A-4D show various views of the strap 10 placed over a sock on a foot according to an embodiment. As illustrated, the offset portion 14 of the strap 10 can be placed over the top of the foot, such that the offset portion 14 is positioned just below, and slightly over the metatarsophalangeal joints of the foot. Subsequently, the strap 10 can be crossed under the arch of the foot, such that the strap 10 lays flat against the foot. The strap 10 can be secured behind the ankle of the user using a set of connecting mechanisms described herein (e.g., hook and loop fasteners).

While the strap 10 shown being secured behind the ankle, it is understood that embodiments of the strap 10 can be configured to be secured anywhere on the user's foot. For example, an embodiment of the strap 10 can be configured to be secured on an interior or exterior portion of an ankle of the user. In this case, the offset portion 14 of the strap 10 can be located more closely to one end of the strap 10 than the other. In a more specific embodiment, for a strap 10 having a total length of approximately twenty inches (51 centimeters), an offset portion 14 of the strap 10 having a length of approximately four inches (10 centimeters), and each of the transition regions 16A, 16B having a length of approximately 1.5 inches (4 centimeters). One end portion of the strap 10 can have a length of approximately 8 inches (20 centimeters) and the other end portion of the strap 10 can have a length of approximately 5 inches (13 centimeters).

In this position, the force of the strap 10 effectively bends the foot, thereby placing the foot in a slight plantar flexion. As a result, the strap 10 holds the foot in a position conducive for a mid-foot/forefoot strike. When the user is running, the mid-foot/forefoot strike will naturally be made, even when the user is wearing athletic shoes. The strap 10 can be configured to provide a slight plantar flexion, which is within the normal range of motion for the user. As a result, the strap 10 will not add strain on the foot. Rather, the strap 10 can place sufficient force on the foot so that the plantar fascia and calf muscles are engaged in active flexion.

In another embodiment, the strap 10 can be placed on a foot to provide a recovery and/or sleeping aid. For example, the strap 10 can be used by an individual dealing with a training-related injury, such as plantar fasciitis, shin splints, tendonitis, and/or the like. Furthermore, the strap 10 can be used to assist in managing muscle tightness in the arch and/or lower leg of a user. To this extent, FIGS. 5A-5D show various views of the strap 10 placed over a sock on a foot according to another embodiment. In this case, the offset portion 14 of the strap 10 can be placed below the foot, such that the offset portion 14 is positioned just below, and slightly over the metatarsophalangeal joints of the foot. Subsequently, the strap 10 can be crossed over the top of the foot, such that the strap 10 lays flat against the foot. The strap 10 can be secured behind the ankle of the user using a set of connecting mechanisms described herein (e.g., hook and loop fasteners). While the strap 10 shown being secured behind the ankle, it is understood that embodiments of the strap 10 can be configured to be secured anywhere on the user's foot. In this position, the force of the strap 10 can stretch the plantar fascia through dorsiflexion.

As described herein, a position of the strap 10 on the foot can be important to provide the desired force, e.g., when worn during running as described herein. In an embodiment, an article of footwear, such as a sock, is configured to assist the user with the correct placement. For example, the sock can include a design element, which identifies the proper location to place the offset portion 14 of the strap 10.

In an embodiment, an article of footwear, such as a sock, is configured to hold the strap 10 in a desired position. For example, FIGS. 6A-6D show various views of a sock 20 and integrated strap 10 placed on a foot according to an embodiment. As illustrated, the sock 20 includes a pair of loops 22A, 22B, which are located on a forward portion of the sock 20 that aligns with opposing sides of a position just below, and slightly over the metatarsophalangeal joints of the foot. In this case, the strap 10 can be inserted through the loops 22A, 22B and the offset portion 14 of the strap 10 can be centrally located between the loops 22A, 22B, thereby assisting the user with proper placement of the strap 10. However, it is understood that the loops 22A, 22B are only illustrative of various solutions that can be utilized. For example, in another embodiment, the strap 10 can be attached to the sock 20 using a set of hook and loop fastener mechanisms located on the strap 10 and sock 20. In this case, the sock 20 can include a single hook or loop fastener mechanism located on top of the sock in the appropriate location, two hook or loop fastener mechanisms located on opposing sides of the sock in the appropriate locations, and/or the like. Regardless, the strap 10 can include the corresponding hook or loop fastener mechanism(s) in the corresponding location(s). Furthermore, the sizes and locations of corresponding hook and loop fastener mechanism(s) can be configured to accommodate feet of varying sizes.

While embodiments described herein use a sock as an illustrative footwear article, it is understood that a strap described herein can be implemented in conjunction with any suitable footwear article. For example, an illustrative footwear article can comprise a shoe, such as a running shoe. More particularly, the running shoe can have minimal cushioning (e.g., racing flats). Furthermore, it is understood that the sock can comprise any type of sock. In a more specific embodiment, the sock is a compression sock, which can be configured to increase circulation in the foot.

While illustrative aspects of the invention have been shown and described herein primarily in conjunction with a foot positioning device, it is understood that aspects of the invention further provide various alternative embodiments.

For example, an embodiment provides a method of holding a foot in a desired position. In this case, a foot positioning device can be placed on the foot in a manner described herein. For example, a strap of the foot positioning device can be placed on the foot as shown in FIGS. 4A-4D or as shown in FIGS. 5A-5D (with or without a sock or other article of footwear being used). Such a method can be incorporated as part of various applications, including athletic training, exercise, therapy, recovery, and/or the like. The foot positioning device can be utilized for any period of time, depending on the corresponding application. For example, the foot positioning device can be worn during a period of athletic activity, such as running or other exercise. When used as part of athletic training or the like, the foot positioning device can be used during a transition period in which the user is adjusting from a "heel strike" running style to a "midfoot strike" running style. In this case, the foot positioning device described herein can provide support for various muscles as they are strengthened as well as assisting in training the user to utilize the different running style.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A foot positioning device comprising:

a strap formed of a single, continuous strip of material for placing a foot in a desired position, the strap including:

a first aligned portion;

a first transition region immediately adjacent to the first aligned portion;

an offset portion immediately adjacent to the first transition region, wherein the offset portion is configured for placement along a forward portion of the foot;

a second transition region immediately adjacent to the offset portion; and a second aligned portion immediately adjacent to the second transition region, wherein first and second aligned portions are aligned, wherein the first and second aligned portions are configured for securing the strap around an ankle, and wherein the first and second transition regions provide a fixed offset distance between the offset portion and the first and second aligned portions.

2. The device of claim 1, wherein the length of the offset portion is approximately one fifth a length of the strap.

3. The device of claim 1, wherein the material is a rubber latex material.

4. The device of claim 3, wherein the rubber latex material has a thickness of approximately 0.1 centimeters and a width of approximately 4 centimeters.

5. The device of claim 1, further comprising means for temporarily securing the first and second aligned portions of the strap to each other.

6. The device of claim 5, wherein the means for temporarily securing includes a hook and loop fastener.

7. The device of claim 1, wherein the length of the offset portion is approximately five times the fixed offset distance.

8. The device of claim 1, wherein the offset portion is rectangular and has a width approximately the same as widths of the first and second aligned portions.

9. The device of claim 1, wherein the first aligned portion has a length larger than the second aligned portion.

10. A foot positioning device comprising:

a strap for placing a foot in a desired position, the strap including:

a first aligned portion;

a second aligned portion, wherein the first and second aligned portions are aligned and have substantially constant widths; and a rectangular offset portion located between the first and second aligned portions, wherein the rectangular offset portion is configured for placement along a forward portion of a foot and the first and second aligned portions are configured for securing the strap around an ankle, and wherein the first and second aligned portions are in parallel with and laterally offset from the rectangular offset portion by a fixed offset distance.

11. The device of claim 10, the strap further comprising:

a first transition region immediately adjacent to the first aligned portion and the rectangular offset portion;

a second transition region immediately adjacent to the second aligned portion and the rectangular offset portion, wherein each of the first and second transition regions has a length approximately twice the fixed offset distance.

12. The device of claim 10, wherein the strap is formed of a single, continuous strip of material.

13. The device of claim 10, wherein the strap is formed of a rubber latex material having a thickness of approximately 0.1 centimeters.

14. The device of claim 10, wherein a length of the rectangular offset portion is approximately five times the fixed offset distance.

15. The device of claim 10, further comprising means for temporarily securing the first and second aligned portions of the strap to each other.

16. The device of claim 15, wherein the means for temporarily securing includes a hook and loop fastener.

17. A foot positioning device comprising:

a strap for placing a foot in a desired position, the strap including:

a first aligned portion;

a second aligned portion, wherein the first and second aligned portions are aligned, and wherein the first and second aligned portions are configured to be temporarily secured to each other; and an offset portion located between the first and second aligned portions, wherein each end of the offset portion is laterally offset from a corresponding end of the first and second aligned portions by a fixed offset distance.

18. The device of claim 17, the strap further comprising:

a first transition region directly connecting a first end of the offset portion to a corresponding end of the first aligned portion; and a second transition region directly connecting a second end of the offset portion to a corresponding end of the second aligned portion, wherein each of the first and second transition regions has a length approximately twice the fixed offset distance.

19. The device of claim 17, wherein the strap is formed of a single, continuous strip of material.

20. The device of claim 17, wherein the strap is formed of a rubber latex material having a thickness of approximately 0.1 centimeters.

* * * * *